United States Patent [19]

Tryon

[11] 3,987,741

[45] Oct. 26, 1976

[54] REMOTE UNMANNED WORK SYSTEM (RUWS) MATING LATCH

[75] Inventor: Paul V. Tryon, Kailua, Hawaii

[73] Assignee: The United States of America as represented by the Secretary of the Navy, Washington, D.C.

[22] Filed: Jan. 12, 1976

[21] Appl. No.: 648,220

[52] U.S. Cl. ..... 114/16 R; 61/69 R; 114/51; 114/235 A; 285/DIG. 21; 294/83 AA

[51] Int. Cl.[2] ..... B63G 8/00; B63G 8/42

[58] Field of Search ..... 114/16 R, 16.4, 51, 114/235 A; 61/69 R, 69 A; 294/83 AA; 403/316, 317, 322, 321; 285/18, 316, DIG. 21

[56] References Cited

UNITED STATES PATENTS

| | | | |
|---|---|---|---|
| 3,245,128 | 4/1966 | Lyles | 285/316 X |
| 3,809,002 | 5/1974 | Nagy et al. | 114/16 R |
| 3,825,980 | 7/1974 | Moore | 294/83 AA |
| 3,853,082 | 12/1974 | Rosenberg et al. | 114/51 |
| 3,863,458 | 2/1975 | Veno | 114/16 R |
| 3,874,013 | 4/1975 | Hudson | 114/51 |
| 3,880,103 | 4/1975 | Talkington | 114/16 R |

*Primary Examiner*—Trygve M. Blix
*Assistant Examiner*—Gregory W. O'Connor
*Attorney, Agent, or Firm*—Richard S. Sciascia; Ervin F. Johnston; Thomas Glenn Keough

[57] ABSTRACT

A remote interconnection of a first undersea vehicle tethered to a second undersea vehicle is assured by mating assemblies carried on both vehicles. The tethering cable extends through a prod assembly carried on the tethered vehicle and functions mainly to deploy and retrieve the tethered vehicle. During the connection of the two vehicles the cable serves to draw the prod assembly into a latching assembly carried on the second undersea vehicle. Several pawls are cammed into an annular groove on the prod assembly and a pair of opposing helical springs mechanically interact to lock the pawls in place. The coaction of the springs' working on a collar on the prod assembly and a sleeve on the latching assembly makes accidental disengagement nearly impossible until hydraulic actuators assist the force produced by the sleeve spring to overcome the force exerted by the collar spring to release the pawls.

7 Claims, 4 Drawing Figures

REMOTE UNMANNED WORK SYSTEM (RUWS) MATING LATCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Mechanisms for coupling vehicles, structural elements or machinery for that matter are many and varied in design. Usually the mechanical coaction called for represents an end product which is commensurate with the evolution of a system. As an example, the technological advancements in undersea technology have fostered a whole new breed of sophisticated undersea craft. Some of the latest developments in this field are the family of unmanned undersea vehicles usually controlled from the surface. Unmanned vehicles have a number of features making them particularly acceptable when hazardous conditions are expected. A recent development has extended the capabilities of existing tethered vehicles. The system is generally referred to as the remote unmanned work system (RUWS). RUWS is capable of performing underwater search, inspection, work, and object recovery tasks at great ocean depths and is provided with acoustic and visual sensing and location devices. This system deploys an interconnected secondary vehicle and a tethered primary vehicle by a relatively heavy cable which also transmits electric power lines and command and control lines etc. The primary vehicle disconnects from the secondary vehicle at or near the work site at a predetermined depth. It is tethered to the secondary vehicle via a lighter weight cable which also feeds power and control signals. The tethered vehicle carries the tools necessary to perform a task and support equipment such as lights, cameras, etc., while the secondary vehicle acts as a platform for power conversion equipment, signal processing circuitry, etc. The advantages of such an arrangement are obvious. Once the task is completed the primary vehicle becomes connected to the secondary vehicle and the entire package is retrieved by a surface support vessel via the heavy cable. Heretofore, problems have arisen because of the coupling between the two vehicles. If the two vehicles are not capable of joining and separating reliably, there is a possibility of damage and consequent mission ineffectiveness. A continuing need exists in the state-of-the-art for a mechanism which ensures reliable joining and separation of a pair of tethered vehicles remotely from a support ship.

SUMMARY OF THE INVENTION

The present invention is directed to providing an apparatus for remotely connecting a primary underwater vehicle tethered by a cable to a secondary underwater vehicle. A prod assembly is mounted on the primary underwater vehicle and includes an elongate prod provided with a coaxial bore sized and shaped to receive and retain the cable therein. An annular groove is machined on the outer surface of the prod and a collar is slidably mounted on the prod and is biased toward the prod's annular groove. A latching assembly is mounted on the secondary underwater vehicle and has a tubular fitting provided with an axial bore sized to slidably receive the prod assembly. The plurality of pawls extends through the tubular fitting and a sleeve slidably carried on the tubular fitting has an interior annular recess for receiving the pawls. The sleeve is biased to a position radially aligning the pawls with the annular recess in the sleeve, upon insertion of the prod assembly in the latching assembly, the biased collar is displaced until the pawls are cammed into the annular groove on the prod at which time the sleeve is axially displaced by the collar to lock the pawls in the annular groove of the prod thereby securing the two assemblies together.

An object of the invention is to provide an improved connection between two tethered underwater vehicles.

Another object is to provide an underwater connection made up of a prod assembly carried on a tethered vehicle and a latching assembly mounted on a secondary vehicle.

Another object is to provide a connection relying upon a coaxially mounted tether cable joining two undersea vehicles together.

Yet another object of the invention is to provide a connection having the capability to be remotely coupled and uncoupled.

Still another object is to provide a connection between undersea vehicles having a locking capability.

A further object is to provide a mechanism for possessing an inherently high degree of reliability by reason of its straightforward, uncomplicated design.

These and other objects of the invention will become more readily apparent from the ensuing description when taken with the drawings.

DESCRIPTION OF THE PREFERRED EMBODIMENT

Figure 1:
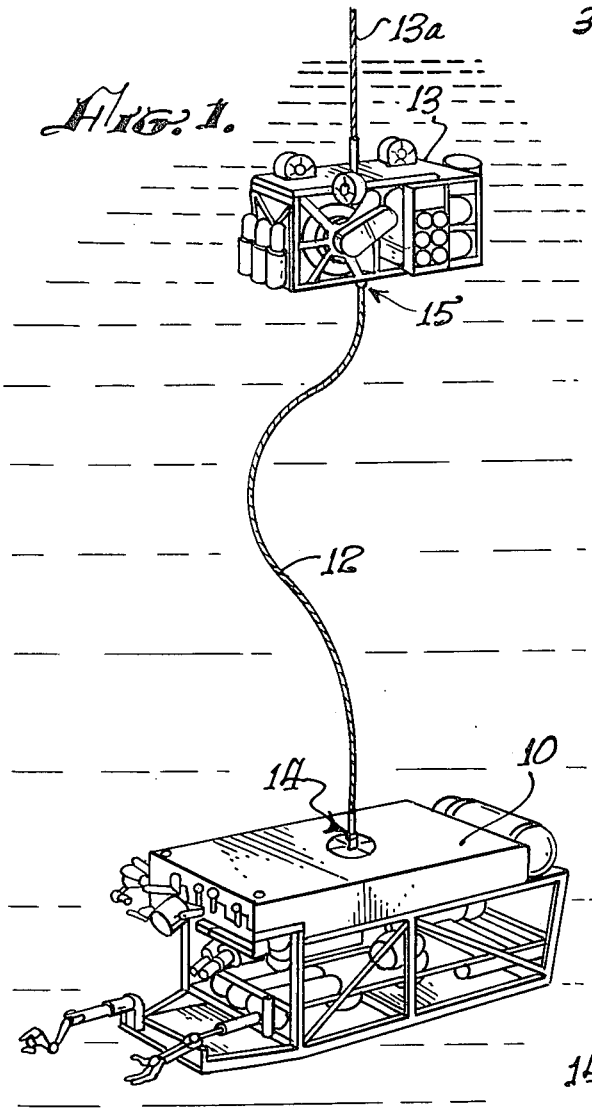
FIG. 1 is an isometric depiction of a portion of the RUWS system.

Referring now to the drawings, and in particular to FIG. 1, a representative embodiment of the RUWS system is depicted as it seeks to accomplish some undersea task. A tethered work vehicle 10 is coupled to the end of a cable 12 which reaches from a secondary vehicle 13. The secondary vehicle is suspended by a heavy duty main cable 13*a* which supplies the power and control functions for the system.

The tethered vehicle can be provided with a variety of devices such as a pair of manipulator arms, flood lights, television cameras, hydraulic actuators, etc. for performing underwater tasks. The secondary vehicle houses most of the support equipment for the primary vehicle such as power conversion units, hydraulic pressure sources, etc.

The cable interconnecting the two vehicles is not as substantially constructed as the main cable, yet it possesses sufficient strength to withstand the abuses of working at extreme depths in the ocean. It may have a multiconductor core for transmitting power and control signals to the tethered vehicle. Optionally, the tethered cable is neutrally buoyant by the inclusion of a number of flotation elements along its length.

The RUWS system is primarily designed for working at great depths. Experience has demonstrated that deployment to the great depths is expedited when the primary work vehicle and secondary support vehicle are connected together during descent and ascent. Once at the desired working depth, the vehicles separate and the primary tethered vehicle is released to accomplish its task.

Highly reliable interconnection between the two vehicles during launch and recovery is assured by the inclusion of a prod assembly 14 carried on the tethered vehicle and a latching assembly 15 mounted on the secondary vehicle.

Figure 2:
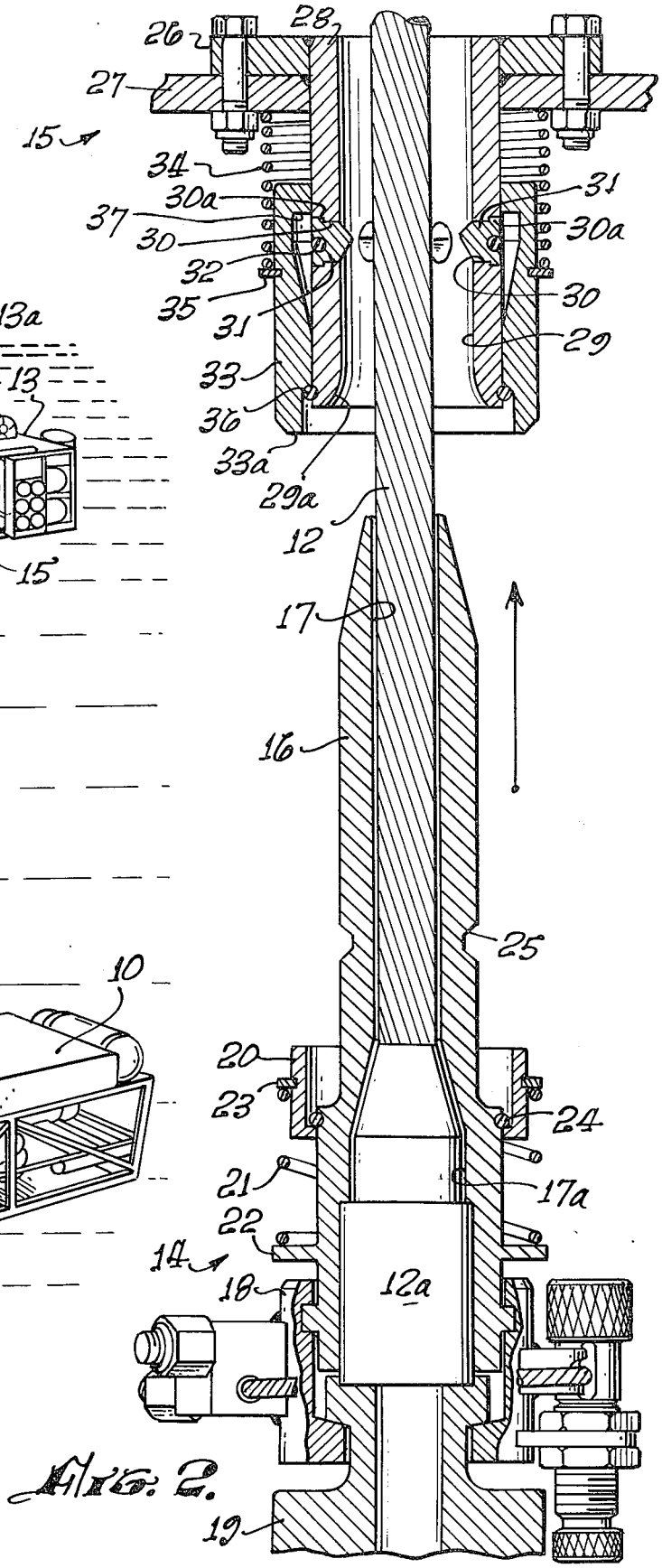
FIG. 2 is a cross-sectional view of the invention with the two assemblies approaching one another.
Figure 3:
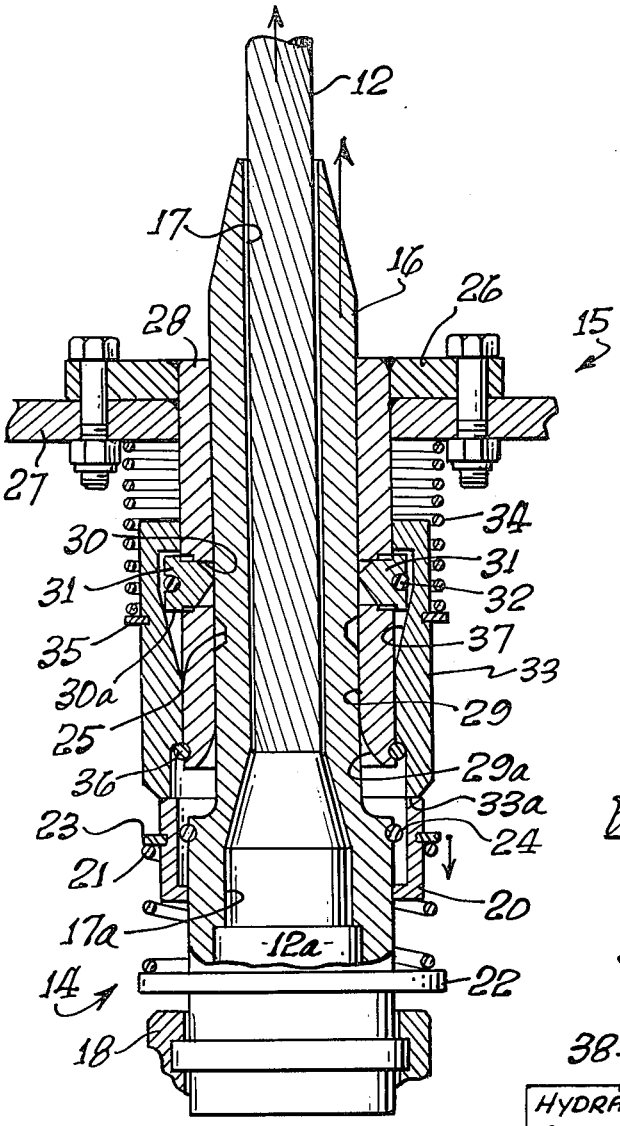
FIG. 3 is a cross-sectional view of the invention showing the partial engagement of the two assemblies.
Figure 4:
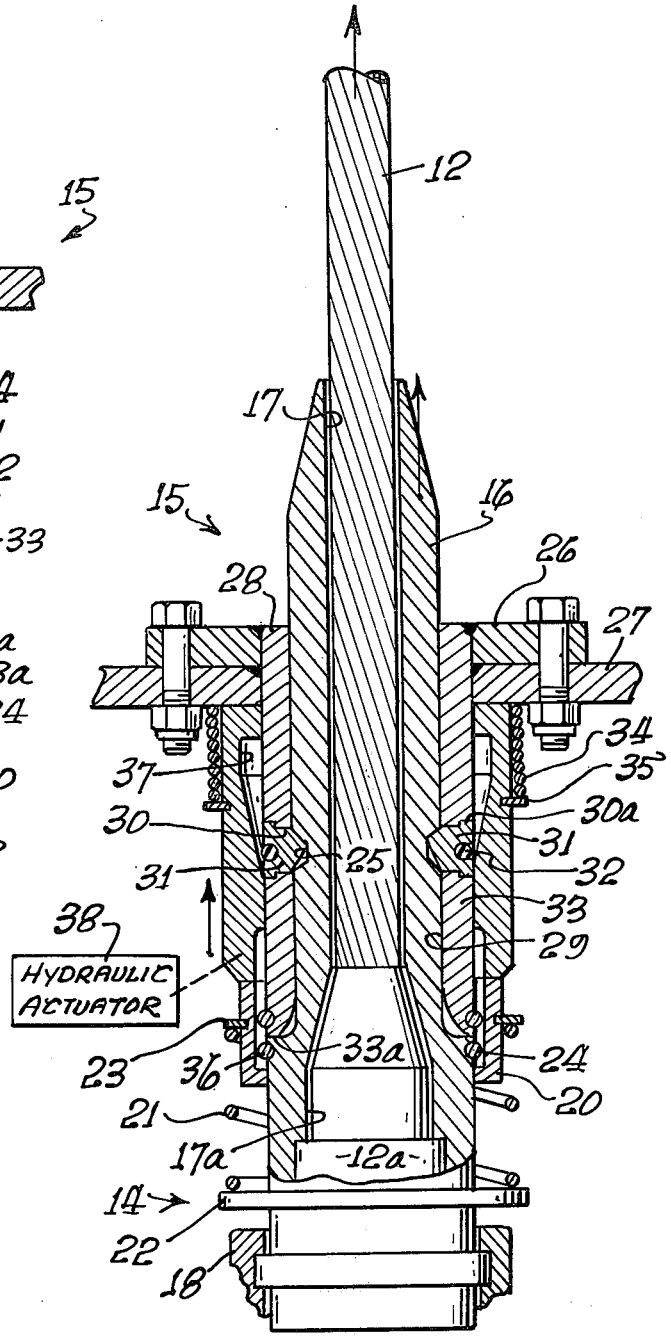
FIG. 4 is a cross-sectional view of the invention fully engaged and locked.

Looking to FIG. 2, showing the two assemblies approaching each other, it is apparent that tethering cable 12 coaxially extends through both the prod assembly and the latching assembly. The cable is reeled in and reeled out of vehicle 13 and is anchored in a prod assembly by a swaged slug 12*a* on its distal end. Power and control conductors extend into the tethered vehicle to perform various functions although they are not shown in the drawings while the load bearing components of the tethered cable terminate in the swaged slug.

The prod assembly includes an elongate prod having a tapered nose portion and is provided with a central bore 17. The bore has a diameter sized to receive the tethering cable and an inner portion 17*a* is enlarged to accommodate the swaged slug. A split collar 18 on the opposite end of the prod secures the prod assembly to a structural member 19 located on the upper surface of the tethered vehicle.

An actuator collar 20 is slidably carried on the outside of an enlarged portion of the prod and is axially forced toward the tip of the prod by a helical biasing spring 21 exerting equal and opposite forces against a rim 22 and a retaining clip 23. The actuator collar is prevented from sliding off the prod by a retaining clip 24 that bears against an inner rim of the actuator collar.

The outer surface of the prod is shaped with an annular groove 25 circumferentially reaching about the prod. The annular groove is disposed for mechanical coaction with latching assembly 15 as the elongate prod slides within a flanged member 26.

The flanged member is anchored to a structural element 27 on vehicle 13 and is welded to a tubularly shaped member 28. The inside of the tubularly shaped member is formed with an axial bore 29 sized to slidably receive elongate prod 16. To facilitate entry of the prod in the latching assembly, an outer lip 29*a* is machined to have a slightly tapered surface to accommodate insertion of the prod.

A number of openings 30 is provided in tubularly shaped member 28 and each have shoulder portions 30*a*. Each of the openings is sized to contain a pawl 31 held therein by a ring shaped resilient retainer 32. In a preferred embodiment of this invention six palls were included being equidistantly circumferentially spaced in a correspondingly number of openings in the tubularly shaped member. Although only two openings and their respective pawls are depicted in the drawings, it is understood that this arrangement is only meant to be representative to show the inventive concept.

A sleeve 33 is carried on the outer surface of the tubularly shaped member and is capable of reciprocal motion thereon. At the furthermost extension of the sleeve a surface 33*a* is formed that is dimensioned to be longitudinally aligned with actuator collar 20 of the prod assembly.

A helical biasing spring 34 tends to urge the sleeve beyond the end of the tubularly shaped member as it exerts a pushing force between a retainer ring 35 and an outer surface of structural member 27. The sleeve is retained on the tubularly shaped member by a keeper ring 36 mounted in a groove provided in the mouth of the tubularly shaped member.

When the sleeve is so extended an annularly tapered recess 37 is aligned with openings 30. This deposition allows the recess to receive the pawls in a manner to be elaborated on below.

The spring constant of spring 34 and the force exerted is less than the spring constant and force of the biasing spring 21. The specific feature ensures reliable locking of the prod assembly and the latching assembly.

Looking to FIG. 2 prod assembly 14 is being drawn into latching assembly 15 by cable 12. Resilient retainer 32 pushes the pawls into axial bore 39 of the tubularly shaped member. As the nose of prod 16 passes the pawls, it cams them into the circumferentially aligned annular tapered recess 37.

Further motion by the prod into the tubularly shaped member brings axially aligned surface 33*a* into contact with actuator collar 20. Since the pawls are pressed against the outer surface of elongate prod 16, they cannot be cammed from annular tapered recess 37 by displacing the sleeve. As tethering cable 12 exerts more force to draw the prod assembly further into the latching assembly, the stronger biasing force of biasing spring 21 is overcome yet biasing spring 34 remains relatively uncompressed. This is because the pawls 32 are wedged between an outer surface of prod 16 and the inner surface of annular tapered recess 37.

However, when annular groove 25 becomes aligned with openings 30 and their respectively contained pawls 31, biasing spring 21 is no longer retained by the otherwise wedged pawls and the spring pushes sleeve 33 toward structural member 27. This motion compresses spring 34 and cams the pawls into locking engagement in annular groove 35 on the prod. The latching prod now has securely locked the prod assembly in place and the two vehicles are secured together.

Unlocking the two assemblies becomes a simple operation. An interconnected hydraulic mechanism, schematically shown by reference character 38 feeds pressurized fluid to an appropriately coupled piston to overcome the biasing force of biasing spring 21. The hydraulically induced force displaces sleeve 33 toward structural member 27.

The retaining tension is relaxed on tethering cable 12 and the weight or downward thrust from tethered vehicle 10 pulls on prod 16. Pawls 31 are cammed out of annular groove 25 in the prod and are repositioned in the radially aligned tapered recess 37. Cable 12 is unreeled from the secondary vehicle and the primary vehicle is remotely deployed. After completion of a task, the vehicles are rejoined as described above.

What has been described in a positive method and apparatus for interconnecting two remotely operating submersibles. This deployment and recovery pose less of a possibility of accidently damaging the vehicles since they are securely interconnected. A tethering vehicle is positively releaseable to perform its undersea task.

Obviously, many modifications and variations of the present invention are possible in the light of the above teachings, and, it is therefore understood that within the scope of the disclosed inventive concept, the invention may be practiced otherwise than specifically described.

What is claimed is:

1. Apparatus for remotely connecting a primary underwater vehicle tethered by a cable to a secondary underwater vehicle comprising:

a prod assembly mounted on the primary underwater vehicle including an elongate prod provided with a coaxial bore sized and shaped to receive and retain the cable therein and further provided with an annular groove on its outer surface, a collar slideably mounted on the prod in a position spaced from the annular groove and means carried on the prod for biasing the collar toward the annular groove and a latching assembly mounted on the secondary underwater vehicle including, a tubular fitting having an axial bore sized to slideably receive the prod assembly therein and being provided with a plurality of openings, at least one pawl extending through the openings and partially into the axial bore a sleeve slideably mounted about the tubular fitting having an interior annular recess for receiving the pawl, means for biasing the sleeve to a position radially aligning the pawl with the annular recess, upon insertion of the prod assembly in the latching assembly, the collar biasing means first compresses until the pawl is cammed into the annular groove on the prod at which time the force of the collar biasing means overcomes the sleeve biasing means axially displacing the sleeve to lock the pawl in the annular groove of the prod.

2. An apparatus according to claim 1 further including:

means for retaining the collar at an extended position on the prod and means for retaining the sleeve at an extended position on the tubular fitting to ensure the aligned coaxial engagement of the collar and tubular fitting as the prod enters the tubular fitting.

3. An apparatus according to claim 2 in which the collar biasing means and the sleeve biasing means are a helical collar spring and a helical sleeve spring, the collar spring has a greater spring constant than the sleeve spring to ensure the positive engagement of the pawl in the annular groove of the prod.

4. An apparatus according to claim 3 in which there are provided a plurality of pawls circumferentially equidistantly spaced in the tubular fitting.

5. An apparatus according to claim 4 in which the collar and prod are provided with a ring and rim respectively to hold the collar spring therebetween and the sleeve and tubular fitting are provided with a ring and surface respectively to hold the sleeve spring therebetween to ensure the extended positioning of the collar and sleeve.

6. An apparatus according to claim 5 in which the prod has a tapered nose section and the tubular fitting has a tapered lip to facilitate engagement.

7. An apparatus according to claim 6 further including:

means coupled to the sleeve for axially displacing it to overcome the biasing force of the collar spring thereby permitting the annular groove on the prod to cam the pawls into the annular recess and release the prod assembly from the latching assembly.

* * * * *